US005725260A

United States Patent [19]

Eikmeier et al.

[11] Patent Number: 5,725,260

[45] Date of Patent: Mar. 10, 1998

[54] LOCKING ARRANGEMENT FOR WINDOWS, DOORS OR THE LIKE

[75] Inventors: Werner Eikmeier, Erkrath; Dietger Frick; Werner Riedel, both of Velbert, all of Germany

[73] Assignee: Wilhelm Weidtmann GmbH & Co. KG, Velbert, Germany

[21] Appl. No.: 551,557

[22] Filed: Nov. 1, 1995

[30] Foreign Application Priority Data

Nov. 8, 1994 [DE] Germany ..... 44 39 903.0
Aug. 2, 1995 [DE] Germany ..... 195 28 320.1

[51] Int. Cl.[6] ..... E05C 19/10

[52] U.S. Cl. ..... 292/129; 292/24; 292/109; 292/DIG. 20

[58] Field of Search ..... 292/341.17, 24, 292/109, 129, DIG. 4, DIG. 20, 25, 31

[56] References Cited

U.S. PATENT DOCUMENTS

| | | | |
|---|---|---|---|
| 92,970 | 7/1869 | Howard | 292/31 |
| 119,479 | 10/1871 | Smith | 292/31 |
| 1,574,023 | 2/1926 | Crompton et al. | 292/24 |
| 1,574,024 | 2/1926 | Crompton et al. | 292/25 |
| 4,383,707 | 5/1983 | Nishimuro | 292/129 X |
| 4,616,861 | 10/1986 | Kurosaki | 292/129 X |

FOREIGN PATENT DOCUMENTS

| | | | |
|---|---|---|---|
| 1554194 | 11/1969 | Germany | 292/129 |
| 25969 | 11/1904 | United Kingdom | 292/24 |

*Primary Examiner*—Rodney M. Lindsey
*Attorney, Agent, or Firm*—McAulay Fisher Nissen Goldberg & Kiel, LLP

[57] ABSTRACT

A locking arrangement comprises a movable control member at the wing and a stationary counter-member at the frame. The control member is arranged at a connecting rod and is displaceable longitudinally along with the latter by means of a handle. In this way, the locking arrangement is displaced between a closing position and a releasing position. In order to achieve a trouble-free arrangement with a reliable closing position, at least one lever with a hook opening is provided in the counter-member which cooperates with the control member as a hook lever. This hook lever is swivelable transversely to the displacement direction of the control member. In the closing position, the hook lever is swiveled toward the control member until a hook opening receives the control member and its outer hook leg engages in front of the control member. In the releasing position, the hook lever is swiveled away from the control member and its outer hook leg is situated outside of the displacement direction of the control member.

18 Claims, 3 Drawing Sheets

LOCKING ARRANGEMENT FOR WINDOWS, DOORS OR THE LIKE

BACKGROUND OF THE INVENTION a) Field of the Invention

The invention is directed to locking arrangement for windows, doors or the like, with a movable control member at the wing or at the frame of the window, on the one hand, and with a stationary counter-member at the frame or wing, on the other hand.

b) Description of the Related Art

In a known arrangement (DE-AS 11 99 159), the connecting rods are located in the fold region of the wing and are displaced longitudinally by a handle provided at the wing. In the most elementary case, the movable control members fitted to the connecting rod are formed by pins and the stationary counter-members are formed by stalking plates or closing plates which are fastened to the fold region of the frame. By means of the handle, the pins can be moved into a closing position with respect to the closing plates, in which position they engage behind the closing plates on the frame side and accordingly secure the wing in its closed position at the frame. However, the pins can also be moved by means of the handle into a releasing position in which they no longer engage behind the closing plates on the frame side and therefore allow the wing to open. With suitable profiling and arrangement of the control members and counter-members it is also possible to achieve positions in which the wing can be swiveled about a horizontal lower axis or about a vertical or horizontal axis located in the center of the wing so as to be tilted with respect to the frame. The arrangement of the movable control members and stationary counter-members can also be carried out in a mirror-inverted manner in that the longitudinally displaceable pins are situated at the frame and the stationary closing plates are located at the wing.

In the known locking arrangements, the closing position of the control member at the counter-member is not ensured. The pin does not assume a fixed position at the cam profile of the closing plate in the closing position. Inaccurate assembly of the locking parts and/or manufacturing tolerances or assembly tolerances result in positional deviations which lead to rattling noises in the closing position or to problems with operation when the handle is actuated.

OBJECT AND SUMMARY OF THE INVENTION

The primary object of the present invention is to develop a reliable locking arrangement of the type mentioned above which automatically ensures a defined position of the movable control member at the stationary counter-member in the closing position.

According to the invention, a locking arrangement for windows, doors, or the like, is provided with a movable control member at the wing or at the frame of a window on the one hand and with a stationary counter-member at the frame or wing on the other hand, wherein the movable control member is arranged so as to be stationary at a connecting rod, but the connecting rod is displaceable longitudinally by a handle, and the control member is displaceable relative to the stationary counter-member between at least one closing position and a releasing position. The improvement in such arrangement comprises that the counter-member has at least one hook lever which is swivelable transversely to the displacement direction of the control member and has a hook opening which is defined on a side remote of a swivel bearing of the hook lever by an outer hook leg. Further, the hook lever is swiveled toward the control member in a closing position of the arrangement until the hook opening receives the control member and the outer hook leg engages in front of the control member whereas in the releasing position of the arrangement, the hook lever is swiveled away from the control member until the outer hook leg leaves the displacement direction of the control member.

In the invention, the counter-member is itself movable and comprises at least one swivelable lever which has a hook opening for receiving the longitudinally displaceable control member and will therefore be referred to hereinafter as "hook lever" for the sake of brevity. The hook lever is swivelable, namely transversely to the displacement direction of the control member. In the closing position of the arrangement the hook lever is swiveled toward the control member until the control member is caught in the hook lever. The hook opening is defined on its side remote of the swivel bearing of the hook lever by an outer hook leg which engages in front of the control member in the closing position and prevents it from moving back. To release the control member, the hook lever need only be swiveled away until its outer hook leg is removed from the displacement path of the control member. Both swiveling movements of the hook lever are automatically effected by the longitudinal displacement of the control member fitted at the connecting rod when the control member exerts a force on the outer hook leg or on the inner hook leg. After the hook leg is swiveled on, the control member can be moved by the handle into other locking positions characteristic of the respective window. In every case, the position of the control member in the hook opening of the hook lever is secured in the closing position.

Other steps and advantages of the invention are indicated in the following description and the drawing. The invention is shown in the drawings by way of an embodiment example.

DESCRIPTION OF THE PREFERRED EMBODIMENTS

Figure 1:
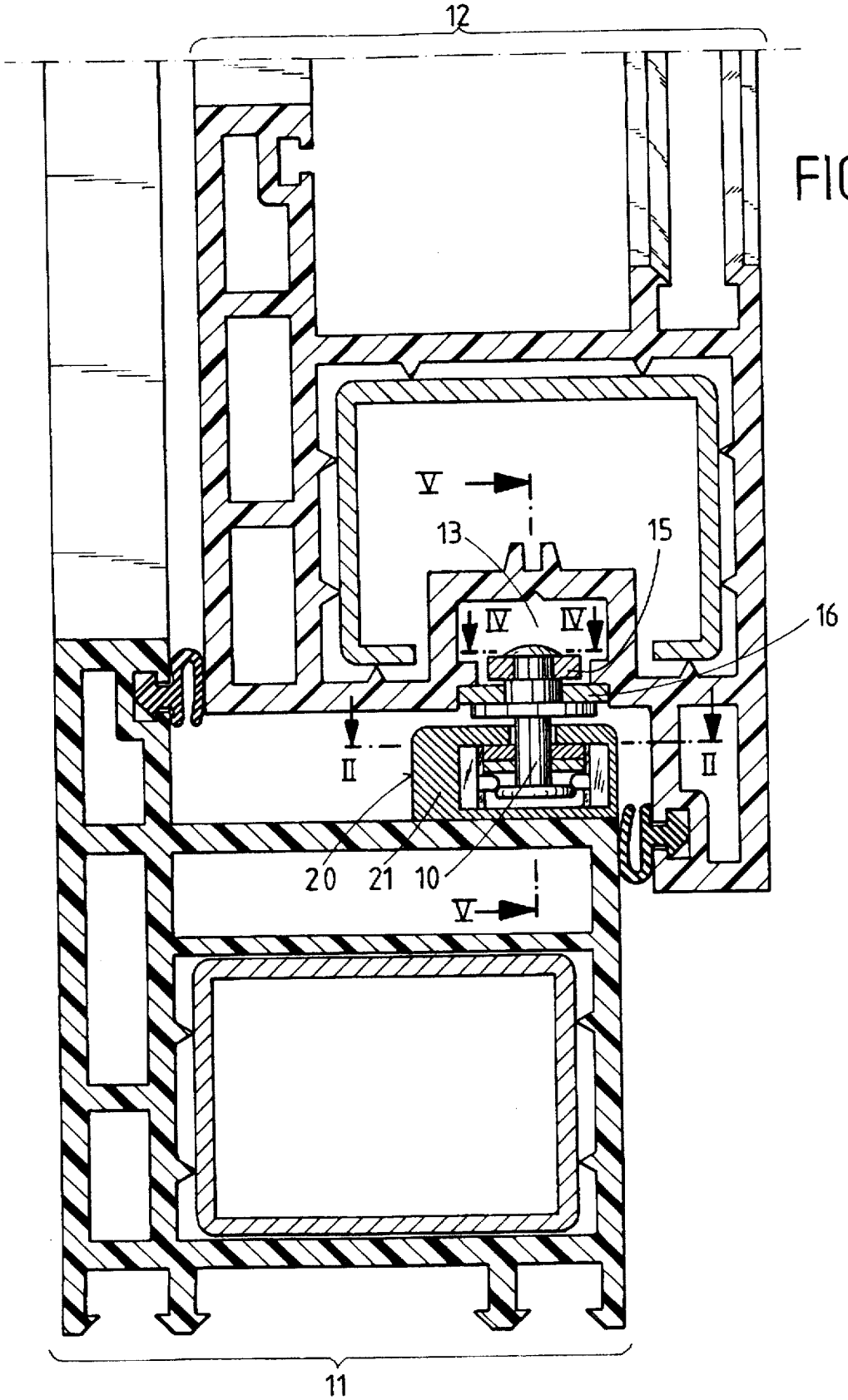
FIG. 1 shows a cross section through the two bottom crosspieces of a wing and a frame of a window in the region of a locking arrangement according to the invention through section line I—I of the locking arrangement shown in FIG. 2 before the latter has been fitted to the window, the two crosspieces being in the position in which they press against one another.

FIG. 1 shows the two crosspieces of a wing 12 and a frame 11 when they occupy a position in which they contact one another when the window is closed. In the fold region, the wing 12 has a longitudinal groove 13, shown in FIGS. 1 and 5, in which is arranged a connecting rod 15. The connecting rod 15 can be displaced longitudinally in the direction shown by the double arrow 14 in FIG. 5 by means of a handle, not shown in more detail, at the wing 12; the direction of arrow 14 accordingly identifies the direction of longitudinal displacement. At least one control member 10 which is carried along during this longitudinal displacement 14 and can accordingly be moved into different positions which are shown in FIGS. 2 to 6 is fitted to this connecting rod 15. In the simplest instance, the control member 10 is formed of a cylindrical pin which, as can be seen from FIG. 1, is attached vertically to the connecting rod 15, e.g., by riveting.

Figure 4:
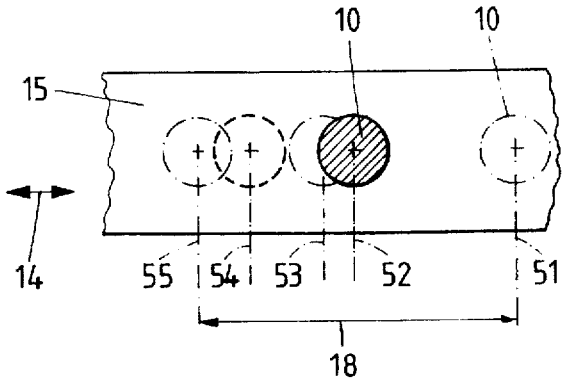
FIG. 4 shows a horizontal section through the control member in a position aligned with FIGS. 2 and 3 in a top view of the connecting rod along section line IV—IV of FIG. 1, omitting adjacent structural component parts which can be seen in FIG. 1.
Figure 5:
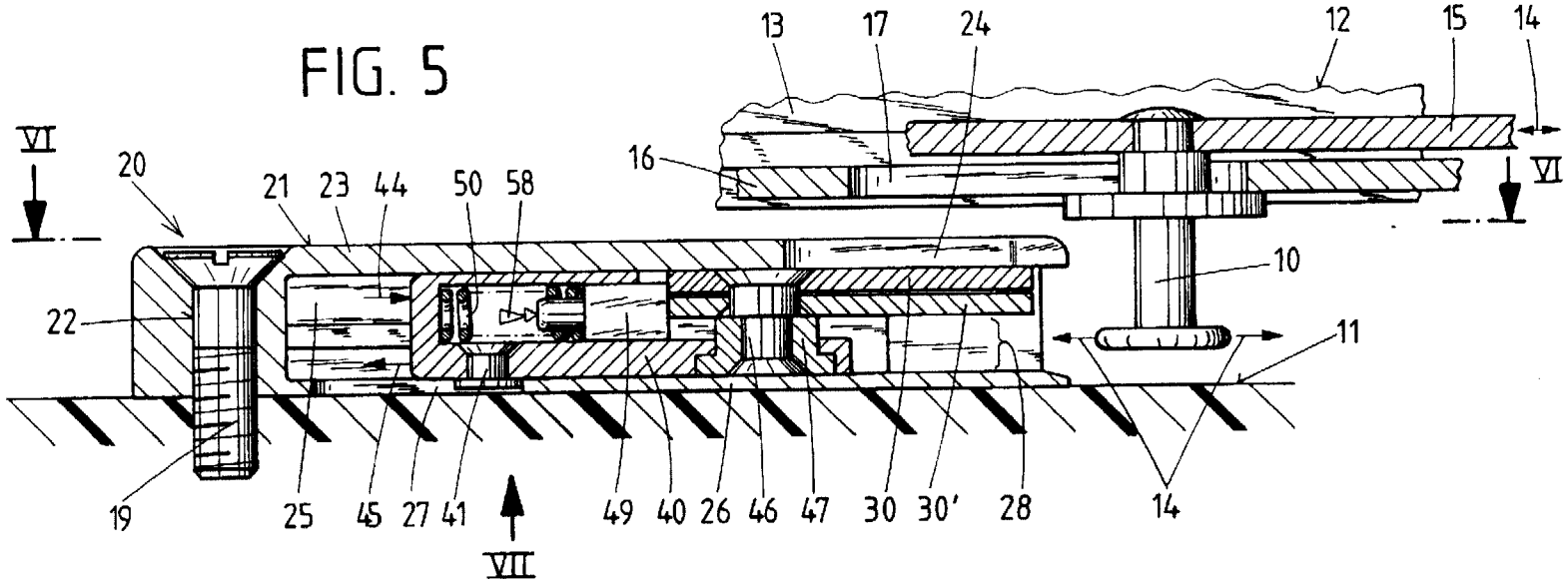
FIG. 5 shows a vertical longitudinal section through the arrangement shown in FIG. 1 when the movable control member is located in a displaced position with respect to FIG. 2.

The longitudinal groove 13 in the wing 12 is closed by a cover rail 16 which has an elongated hole 17, shown in FIG. 5, through which the cylindrical control member 10 projects into the fold region. The maximum displacement path 18 of the control member 10 is shown in FIG. 4. The elongated hole 17 in the cover rail 16 is, of course, designed so as to be long enough not to impair the movement of the control member 10 in the wing 12 along the displacement path 18. An optional number of control members 10 can be fitted to the connecting rod 15 and can also have different profile shapes.

A counter-member 20 which is formed of a plurality of structural component parts, one of which is fastened at a defined location of the frame 11, is associated with the control member 10 located at the wing 12. Conversely, of course, the movable control member 10 could be arranged at the frame 11 and the counter-member 20 could be arranged at the wing 12.

Figure 2:
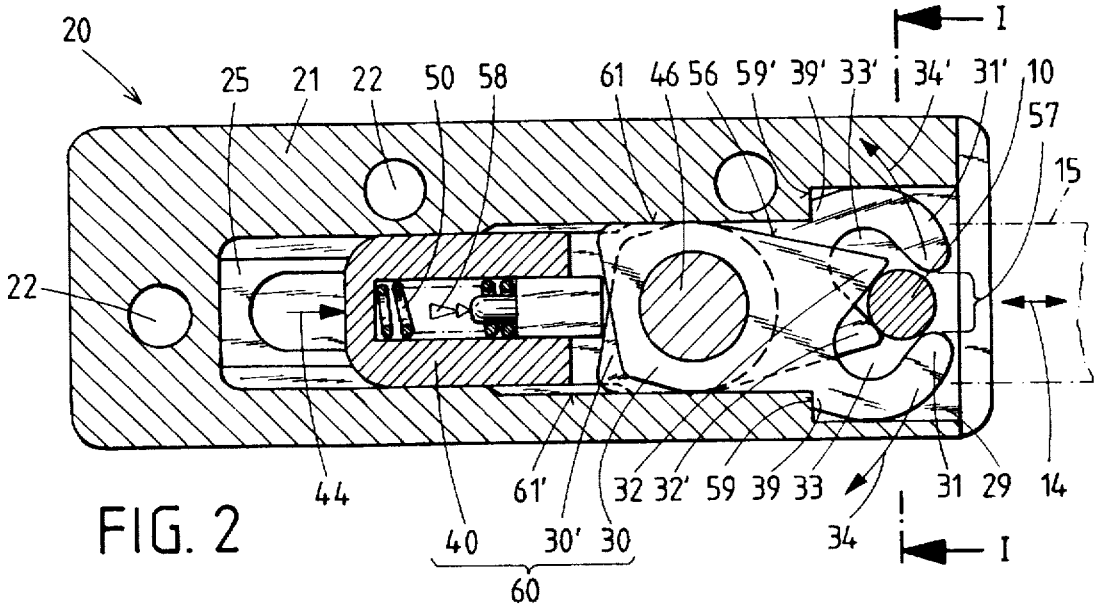
FIG. 2 shows a horizontal longitudinal section through the locking arrangement, according to the invention, along section line II—II of FIG. 1, namely in a releasing position between the control member and the counter-member of the arrangement.
Figure 3:
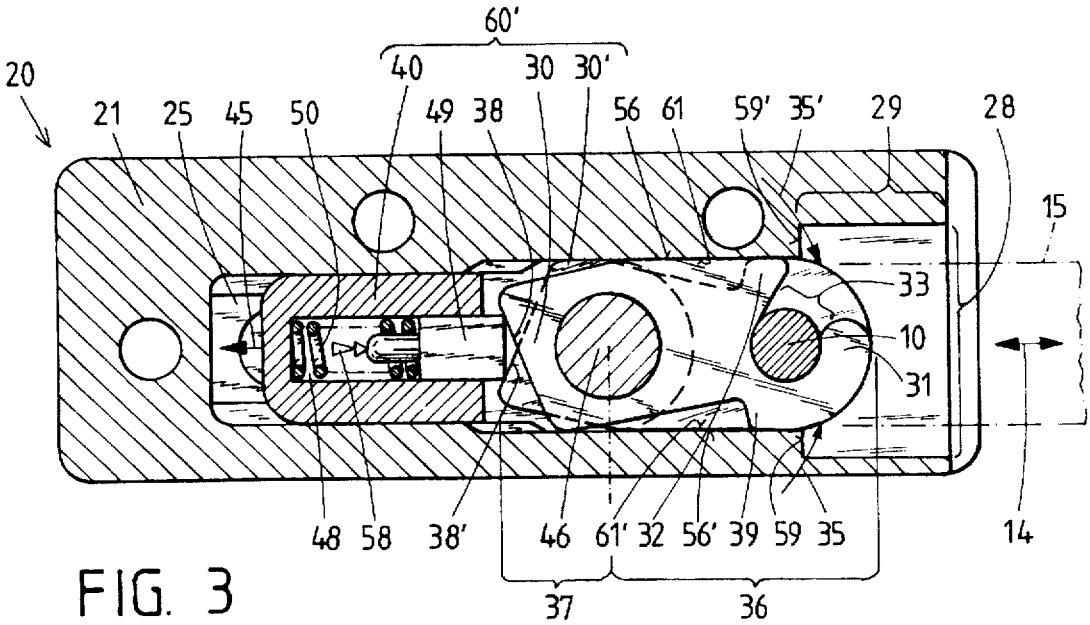
FIG. 3 shows a longitudinal section corresponding to FIG. 2, where the control member and the counter-member occupy the closing position.

As can be seen most clearly from FIG. 2, the counter-member 20 comprises a housing 21 having a plurality of fastening holes 22 for guiding through fastening screws 19 which can be seen in FIG. 5. The fastening screws 19 secure the housing 21 at the frame 11 in a stationary manner. The housing 21 has an upper plate 23, shown in a top view in FIG. 6, with an elongated slot 24 within which the control member 10 can move into determined positions during its longitudinal displacement 14. A slide guide 25 for a slide 40 which can move into different longitudinal positions as will be seen from FIGS. 2 and 3 is located in the interior of the housing 21 and extends substantially in the displacement direction 14. Also associated with the slide guide 25 is an elongated hole 27 in a bottom plate 26 which is associated with the housing 21 as will be seen from the view in FIG. 7. A mounting pin 41 arranged at the slide 40 engages in the elongated hole 27 and does not prevent the slide 40 from its outward 44 and inward 45 sliding movement which is to be described more fully in the following, but provides for a permanent connection with the housing 21. The mounting pin 41 can cooperate in the manner of a stop with the ends of the elongated hole 27 which are designated by 42 and 43 in FIG. 7 and accordingly defines a maximum slide-out position and/or slide-in position of the slide 40.

As another one of its structural component parts the counter-member 20 has at least one lever 30 which has a hook opening 33 and will therefore be referred to hereinafter as a "hook lever" for the sake of brevity. The hook lever 30 is formed of a profiled plate which extends parallel to the upper plate 23 of the housing 21 and is connected with the slide 40 via a swivel bearing 46 as will be seen from FIG. 5. The swivel bearing 46 extends into a bearing sleeve 47 which is anchored in the slide 40. The slide 40 can always be slid out and in the direction of arrows 44, 45 in FIGS. 2 and 3 jointly with the hook lever 30 which is supported at the slide 40. The slide 40 and the hook lever 30 accordingly form a constructional unit which is displaceable in its entirety in the housing 21. Two longitudinal positions 60, 60' of this constructional unit are shown in FIGS. 2 and 3.

The present embodiment example is provided with two hook levers 30, 30' which are identical in shape and are positioned with their two hook openings 33, 33' in a mirror-inverted manner with respect to one another and are jointly supported at the same swivel bearing 46 of the side 40. Since they are identical in shape, it will be sufficient to describe only one hook lever 30, this description also applying to the second hook lever 30' in a corresponding sense. The structural component parts of the hook lever 30, 30' are designated in the following by the same reference numbers, where a mark (') is used to distinguish those of the second lever 30'.

The hook opening 33, 33' is defined by two hook legs 31, 32 and 31', 32', respectively, which produce a free space between them corresponding to the cross section of the control member 10. As will be explained more fully with reference to FIG. 3, the hook lever 30 is a double-armed construction and has an outer lever arm 36 having the respective lever opening 33 or 33' and, on the opposite side of the swivel bearing 46, an inner lever arm 37 having an inclined profile 38 and 38' at its inner end. A spring force 58 acts at this inclined profile 38, 38'. This spring force is generated in this instance by a spiral-shaped pressure spring 50 which is arranged in an axial bore hole 48 of the slide 40 and acts upon a tappet 49 which is displaceable longitudinally within this bore hole 48. In this way, the following actions are achieved.

Figure 7:
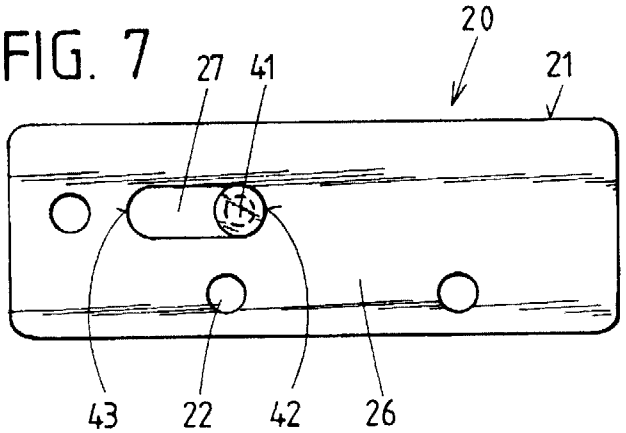
FIG. 7 shows a bottom view of the counter-member shown in FIG. 5 considered in the direction indicated by arrow VII, omitting the frame and the fastening.
Figure 6:
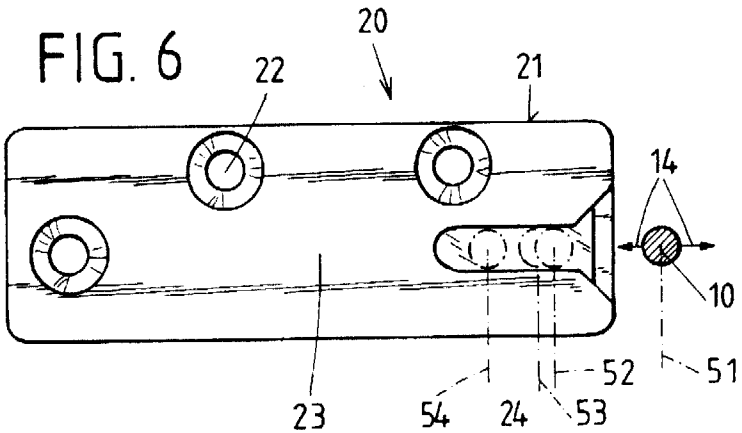
FIG. 6 shows, in reduced scale compared with FIG. 5, a horizontal sectional view through the control member along section line VI—VI of FIG. 5 and a sectional top view of the stationary counter-member of the closure according to the invention, wherein the frame crosspiece is not shown.

In a wing 12 which is articulated at the frame 11 via hinges, an unlocking position in which the wing 12 is freely movable relative to the frame 11 is achieved when the cylindrical control member 10 is located in its first position 51 which is shown in FIGS. 5 and 6 and also indicated in FIG. 6 by a corresponding dash-dot position. The aforementioned constructional unit formed by the slide 40 and the two hook levers 30, 30' then occupies its slide-out position 60 which is shown in FIG. 2. This position is determined in that the slide 40 has moved to the maximum extent in the slide-out direction indicated by arrow 44 toward a housing opening 28 of the housing 21. In FIG. 2, the pin 10 is shown with shading in a subsequent second position and should be disregarded for the present. The slide-out position 60 of the constructional unit is defined by the limit stop 42 of the mounting pin 41 associated with the slide 40. The limit stop 42 was already described and is shown in FIG. 7. The two plate-shaped hook levers have a defined contour shape which, as can be seen most clearly in FIG. 3, forms a projection 39 at the longitudinal edge directed away from the hook opening 33, this projection 39 merging into the aforementioned outer hook leg 31 via a widening of the plate of the hook lever 30.

In the slide-out position 60 shown in FIG. 2, the outer hook legs 31 and 31' of the two hook levers 30, 30' are located in a widened portion 29 of the housing. As a result of the spring force 58 mentioned above, which is generated by the pressure spring 50, torques occur in a mirror-inverted manner with respect to one another at the inclined profiles 38, 38'. These torques generate the swiveling movements at the hook levers 30, 30' as illustrated by the rotational arrows 34, 34' in FIG. 2 and spread the hook levers 30, 30' apart. In this way the outer hook legs 31, 31' are spread apart in the housing widening 29 and their two projections 39, 39' come to rest in front of shoulders 59 and 59' which define the housing widening 29 inwardly as will be seen from FIG. 3. Consequently, in their spread apart position 34, 34' which is shown in FIG. 2 the two projections 39, 39' are engaged by the shoulders 59, 59' and the constructional unit is accordingly also prevented from sliding in unintentionally. The slide-out position 60 of the constructional unit is also accurately determined in this way relative to a sliding in movement illustrated by arrow 45.

When the control member 10 is moved into its position 52, shown in solid lines in FIGS. 4 and 2, by means of actuating the handle, it strikes the two overlapping inner hook legs 32, 32' of the two hook levers 30, 30'. In the spread apart position of the hook levers 30, 30' there remains between the two outer hook legs 31, 31' a passage or through-opening 57 sufficient for the control member 10 as can be seen from FIG. 2. The inner hook legs 32, 32' are inclined in opposite directions relative to one another. By continued longitudinal displacement 14 of the connection rod 15, the control member 10 reaches the third position 53, shown in dashed lines in FIG. 4, in which a force is exerted on the inclined inner hook legs 32, 32'. This force produces a torque directed opposite to the spreading movement 34, 34' mentioned above and swivels the two hook levers 30, 30' toward one another in the direction of the rotational arrows 35, 35' shown in FIG. 3. The two hook levers 30, 30' are accordingly folded together and enclose the control member 10 on all sides between their two hook openings 33, 33' in the manner of pliers. During this folding movement 35, 35' the two projections 39, 39' at the longitudinal edges of the two hook levers 30, 30' are lifted out of the respective shoulders 59, 59' of the housing widening 29. The constructional unit can accordingly be slid in farther in the direction of arrow 45 in FIG. 3 and finally reaches the fourth position 54 shown in solid lines in FIG. 3 and in dash-dot lines in FIG. 4.

The full slide-in position 60' of the constructional unit formed of the slide 40 and the two hook levers 30, 30' is shown in FIG. 3. During the folding together of the two hook levers 30, 30', the tappet 49 was slid into the slide bore hole 48 via the inclined profile 38, 38' and the pressure spring 50 was accordingly compressed. The spring force 58 generated by the latter is actually increased compared with the situation shown in FIG. 2 and consequently exerts a greater torque which generates the spreading movement 34, 34', although this torque cannot take effect in the slide-in position 60'. That is, the respective longitudinal edge 56 or 56' of the two hook levers 30, 30' which faces the hook opening 33 or 33' slides along a guide surface 61, 61' in the interior of the housing 21 during the slide-in movement 45. The guide surface 61, 61' is shown in FIG. 2. In the slide-in position 60' of the constructional unit shown in FIG. 3, the guide surfaces 61, 61' which are directed toward one another keep the two hook levers 30, 30' pressed against one another in the folded together position via the longitudinal lever edges 56, 56'. The spring force 58 of the pressure spring 50 is accordingly disabled with respect to swiveling.

The full closing position of the control member 10 in the counter-member 20 is shown in FIG. 3. The control member 10 is enclosed on all sides by the two hook levers 30, 30' and therefore assumes a defined position. The wing 12 is therefore locked at the frame 11 in a particularly dependable manner by means of the locking arrangement 10, 20 according to the invention.

As is indicated in dash-dot lines in FIG. 4, the control member 10 could be slid in further to a position 55 shown in dash-dot lines as the result of a continued longitudinal displacement 14 of the connecting rod 15 without impairing the reliability of the locking of the wing and frame. This can be ensured by suitably large dimensioning of the elongated hole 27 when the limit stop 43 which was already mentioned above and is shown in FIG. 7 is disposed inward to a sufficient extent.

The locking arrangement is moved out of its closing position, shown in FIG. 3, into its full releasing position, shown in FIG. 5, in the direction opposite to the movement described above. In so doing, the connecting rod 15 is slid back in the direction of arrow 14, during which the spreading force 58 of the pressure spring 50 remains ineffective relative to the two hook levers 30, 30' in the first movement phase until reaching position 53 of the control member 10 shown in FIG. 4. The longitudinal edges 56, 56' of the levers contact the housing guide surfaces 61, 61' mentioned above. The spring force 58 can take effect and cause the spreading movement 34, 34' of the two hook levers 30, 30' only after the widened outer hook legs 31, 31' have reached the described housing widening 29 shown in FIG. 2. There will then again be a through-opening 57 between the two outer hook legs 31, 31' which is sufficiently large for moving the control member 10 into its outermost position 51 shown in FIGS. 4, 5 and 6. The control member 10 is now located outside of the housing 21 again. The wing 12 is unlocked from the frame 11.

While the foregoing description and drawings represent the preferred embodiments of the present invention, it will be obvious to those skilled in the art that various changes and modifications may be made therein without departing from the true spirit and scope of the present invention.

What is claimed is:

1. A locking arrangement for windows and doors, with a movable control member at a wing or at a frame of the window on the one hand and with a stationary counter-member at the frame or wing on the other hand, wherein the movable control member is arranged so as to be stationary at a connecting rod, but the connecting rod is displaceable longitudinally by means of a handle, and the control member is displaceable relative to the stationary counter-member along a displacement path between at least one closing position and a releasing position, wherein:

the counter-member has at least one hook lever which is swivelable transversely to the displacement direction of the control member and has a hook opening which is defined on a side remote of a swivel bearing of said hook lever by an outer hook leg;

said hook lever is swiveled toward the control member in a closing position of the arrangement until said hook opening receives the control member and said outer hook leg engages in front of the control member, whereas in the releasing position of the arrangement the hook lever is swiveled away from the control member until said outer hook leg leaves the displacement path of the control member;

the hook lever is mounted such that the control member carries the hook lever in displacement therewith when the control member is displaced between the releasing position and closing position and displaces the hook lever in a compulsory manner in a housing of the counter-member between a slide-out position defining the releasing position and a slide-in position determining the closing position;

a guide surface is provided which holds said hook lever swiveled toward the control member in the slide-in position, but renders the lever swivelable in the slide-out position;

the hook opening is defined or limited on its side facing the swivel bearing by an inner hook leg;

the inner and outer hook legs extend at an inclination to the displacement direction of the control member as viewed in the slide-out position or in the slide-in position of the hook lever; and the control member strikes against the outer hook leg when the control member is displaced into its slide-out position, but strikes against the inner hook leg when displaced in its slide-in position, so that a force is exerted by the control member on one or the other inclined hook leg with a force component which causes the hook lever to swivel toward the control member or causes the hook lever to swivel away from the control member.

2. The arrangement according to claim 1, wherein the hook lever has a projection on a longitudinal side facing away from the hook opening and the housing has a shoulder in front of which said projection engages in the releasing of the hook lever so that the slide-out position of the hook lever is secured.

3. The arrangement according to claim 1, wherein a spring is integrated in the housing and tends to move the hook lever into its releasing position.

4. The arrangement according to claim 3, wherein the hook lever is double-armed, with an outer lever arm which is located on one side of the swivel bearing and has the hook opening and with an inner lever arm which is arranged at the other side of the swivel bearing and is acted upon by the spring.

5. The arrangement according to claim 4, wherein the force of the spring extends substantially parallel to a slide guide of the lever in the housing but acts on the end of the inner lever arm via an inclined profile and accordingly exerts a torque on the hook lever.

6. The arrangement according to claim 5, wherein the swivel bearing of the hook lever is arranged at a slide and the slide is located in the slide guide of the housing.

7. The arrangement according to claim 6, wherein the spring is integrated in the slide.

8. The arrangement according to claim 6, further comprising a limit stop provided between the slide guide in the housing and the slide to limit the sliding of the hook lever in the housing.

9. The arrangement according to claim 1, wherein the counter-member has two hook levers with hook openings facing one another, the hook levers being swivelable in a mirror-inverted manner relative to one another, the control member at the connecting rod is associated with the two hook openings, the two hook levers are folded onto one another in the closing position and grasp the control member of the connecting rod between them with their two hook openings, and the two hook levers are spread apart in the releasing position and produce a through-opening for the control member between their outer hook legs.

10. The arrangement according to claim 9, wherein each of the hook levers has an inner hook leg, and the inner hook legs of the two hook levers overlap one another in the releasing position and are inclined in opposite directions relative to one another.

11. The arrangement according to claim 9, wherein the hook levers share a common swivel bearing, the housing of the counter-member being a stationary housing with a slide guide for the swivel bearing of the hook levers, the swivel bearing being arranged at a slide located in the slide guide, and wherein the control member carries the hook lever in displacement therewith when the control member is displaced between the releasing position and closing position and displaces the hook lever in a compulsory manner in the housing between the slide-out position defining the releasing position and the slide-in position determining the closing position.

12. The arrangement according to claim 11, wherein the stationary housing includes two guide surfaces in the housing associated with the two hook levers which are grasped therebetween and held so as to be folded toward one another in the slide-in position, and only one common spring is provided for the two hook levers, this spring tending to spread the two hook levers apart.

13. The locking arrangement according to claim 1, wherein the housing of the counter-member is a stationary housing with a slide guide for the swivel bearing of the hook lever.

14. The locking arrangement according to claim 13 wherein the said guide surface is a guide surface provided on the housing, the hook lever sliding along the guide surface when displaced between the slide-out position and the slide-in position of the hook lever.

15. The locking arrangement according to claim 1 wherein the said guide surface is a guide surface provided on the housing, the hook lever sliding along the guide surface when displaced between the slide-out position and the slide-in position of the hook lever.

16. In a locking arrangement for windows and doors, with a movable control member at a wing or at a frame of the window on the one hand and with a stationary counter-member at the frame or wing on the other hand, wherein the movable control member is arranged so as to be stationary at a connecting rod, but the connecting rod is displaceable longitudinally by a handle, and the control member is displaceable relative to the stationary counter-member along a displacement path between at least one closing position and a releasing position, the improvement comprising:

that the counter-member has at least one hook lever which is swivelable transversely to the displacement direction of the control member and has a hook opening which is defined on a side remote of a swivel bearing of said hook lever by an outer hook leg;

said hook lever is swiveled toward the control member in a closing position of the arrangement until said hook opening receives the control member and said outer hook leg engages in front of the control member, whereas in the releasing position of the arrangement the hook lever is swiveled away from the control member until said outer hook leg leaves the displacement path of the control member; and resilient means engaging said hook lever for biasing said hook lever into the releasing position.

17. In a locking arrangement for windows and doors, with a movable control member at a wing or at a frame of the window on the one hand and with a stationary counter-member at the frame or wing on the other hand, wherein the movable control member is arranged so as to be stationary at a connecting rod, but the connecting rod is displaceable longitudinally by a handle, and the control member is displaceable relative to the stationary counter-member along a displacement path between at least one closing position and a releasing position, the improvement comprising:

that the counter-member has at least one hook lever which is swivelable transversely to the displacement direction of the control member and has a hook opening which is defined on a side remote of a swivel bearing of said hook lever by an outer hook leg;

said hook lever is swiveled toward the control member in a closing position of the arrangement until said hook opening receives the control member and said outer hook leg engages in front of the control member, whereas in the releasing position of the arrangement the hook lever is swiveled away from the control member until said outer hook leg leaves the displacement path of the control member;

the counter-member has two hook levers with hook openings facing one another, the hook levers being swivelable in a mirror-inverted manner relative to one another, the control member at the connecting rod is associated with the two hook openings, the two hook levers are folded onto one another in the closing position and grasp the control member of the connecting rod between them with their two hook openings, and the two hook levers are spread apart in the releasing position and produce a through-opening for the control member between their outer hook legs;

the hook levers share a common swivel bearing, the counter-member having a stationary housing with a slide guide for the swivel bearing of the hook levers, the swivel bearing being arranged at a slide located in the slide guide, and wherein the control member carries the hook lever in displacement therewith when the control member is displaced between the releasing position and closing position and displaces the hook lever in a compulsory manner in the housing between a slide-out position defining the releasing position and a slide-in position determining the closing position; and the stationary housing of the counter-member has two guide surfaces associated with the two hook levers which are grasped therebetween and held so as to be folded toward one another in the slide-in position, and only one common spring is provided for the hook levers, this spring tending to spread the two hook levers apart.

18. In a locking arrangement for windows and doors, with a movable control member at a wing or at a frame of the window on the one hand and with a stationary counter-member at the frame or wing on the other hand, wherein the movable control member is arranged so as to be stationary at a connecting rod, but the connecting rod is displaceable longitudinally by a handle, and the control member is displaceable relative to the stationary counter-member along a displacement path between at least one closing position and a releasing position, the improvement comprising:

that the counter-member has at least one hook lever which is swivelable transversely to the displacement direction of the control member and has a hook opening which is defined on a side remote of a swivel bearing of said hook lever by an outer hook leg;

said hook lever is swiveled toward the control member in a closing position of the arrangement until said hook opening receives the control member and said outer hook leg engages in front of the control member, whereas in the releasing position of the arrangement the hook lever is swiveled away from the control member until said outer hook leg leaves the displacement path of the control member;

the counter-member has a stationary housing with a slide guide for the swivel bearing of the hook lever, and wherein the control member carries the hook lever in displacement therewith when the control member is displaced between the releasing position and closing position and displaces the hook lever in a compulsory manner in the housing between a slide-out position defining the releasing position and a slide-in position determining the closing position;

wherein the hook opening is defined on a side facing the swivel bearing by an inner hook leg, the control member striking against the inner hook leg when the control member is slid into the housing and moves from the releasing position into the closing position, whereas the control member presses against the outer hook leg when the control member moves out of the housing and is displaced from the closing position into the releasing position; and the counter-member has two hook levers with hook openings facing one another, the hook levers being swivelable in a mirror-inverted manner relative to one another, the control member at the connecting rod is associated with the two hook openings, the two hook levers are folded onto one another in the closing position and grasp the control member of the connecting rod between them with their two hook openings, and the two hook levers are spread apart in the releasing position and produce a through-opening for the control member between their outer hook legs.

* * * * *